US010494691B2

(12) United States Patent
Eberlein

(10) Patent No.: US 10,494,691 B2
(45) Date of Patent: Dec. 3, 2019

(54) METHOD FOR PRODUCING A COATED BODY HARDENED BY HOT FORMING AS WELL AS A BODY PRODUCED ACCORDING TO THE METHOD

(71) Applicant: GM GLOBAL TECHNOLOGY OPERATIONS LLC, Detroit, MI (US)

(72) Inventor: Wolfgang Eberlein, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 247 days.

(21) Appl. No.: 15/383,871

(22) Filed: Dec. 19, 2016

(65) Prior Publication Data

US 2017/0175215 A1 Jun. 22, 2017

(30) Foreign Application Priority Data

Dec. 19, 2015 (DE) ..... 10 2015 016 656

(51) Int. Cl.

| | |
|---|---|
| ***C21D 1/06*** | (2006.01) |
| ***C21D 8/00*** | (2006.01) |
| ***C21D 9/00*** | (2006.01) |
| ***C25D 11/08*** | (2006.01) |
| ***C25D 11/18*** | (2006.01) |

(52) U.S. Cl.

CPC ..... *C21D 9/0068* (2013.01); *C21D 1/06* (2013.01); *C21D 8/005* (2013.01); *C25D 11/08* (2013.01); *C25D 11/18* (2013.01)

(58) Field of Classification Search

CPC ..... C21D 1/06; C21D 8/005; C21D 9/0068; C25D 11/08; C25D 11/18

See application file for complete search history.

(56) References Cited

U.S. PATENT DOCUMENTS

| | | | | |
|---|---|---|---|---|
| 7,673,485 | B2 | 3/2010 | Imai et al. | |
| 8,021,497 | B2 * | 9/2011 | Fleischanderl | C21D 1/673 148/277 |
| 9,090,951 | B2 * | 7/2015 | Brandstatter | C21D 1/68 |
| 9,194,034 | B2 | 11/2015 | Steins et al. | |
| 9,909,194 | B2 * | 3/2018 | Puerta Velasquez | C21D 1/74 |
| 2011/0236719 | A1 * | 9/2011 | Hensen | C21D 1/673 428/659 |
| 2014/0170438 | A1 * | 6/2014 | Baumgart | C21D 9/46 428/659 |
| 2016/0083830 | A1 * | 3/2016 | Cheney | C23C 4/08 428/553 |
| 2016/0348209 | A1 * | 12/2016 | Baumgart | C21D 9/46 |
| 2017/0260599 | A1 * | 9/2017 | Puerta Velasquez | C21D 1/74 |
| 2017/0268078 | A1 * | 9/2017 | Sanadres | C21D 8/0278 |

FOREIGN PATENT DOCUMENTS

| | | | |
|---|---|---|---|
| AT | 412878 | B | 8/2005 |
| CN | 1829816 | A | 9/2006 |
| DE | 102009042026 | A1 | 3/2011 |
| WO | 2011067008 | A1 | 6/2011 |

* cited by examiner

*Primary Examiner* — Cam N. Nguyen

(74) *Attorney, Agent, or Firm* — Lorenz & Kopf, LLP

(57) ABSTRACT

A method is disclosed for producing a coated body hardened by hot forming. The base body is austenitized in a method step. The coating of the precoated base body is oxidized artificially prior to this method step. A body produced according to the method has an oxidized layer with a thickness of between 0.05 μm and 30 μm.

19 Claims, 1 Drawing Sheet

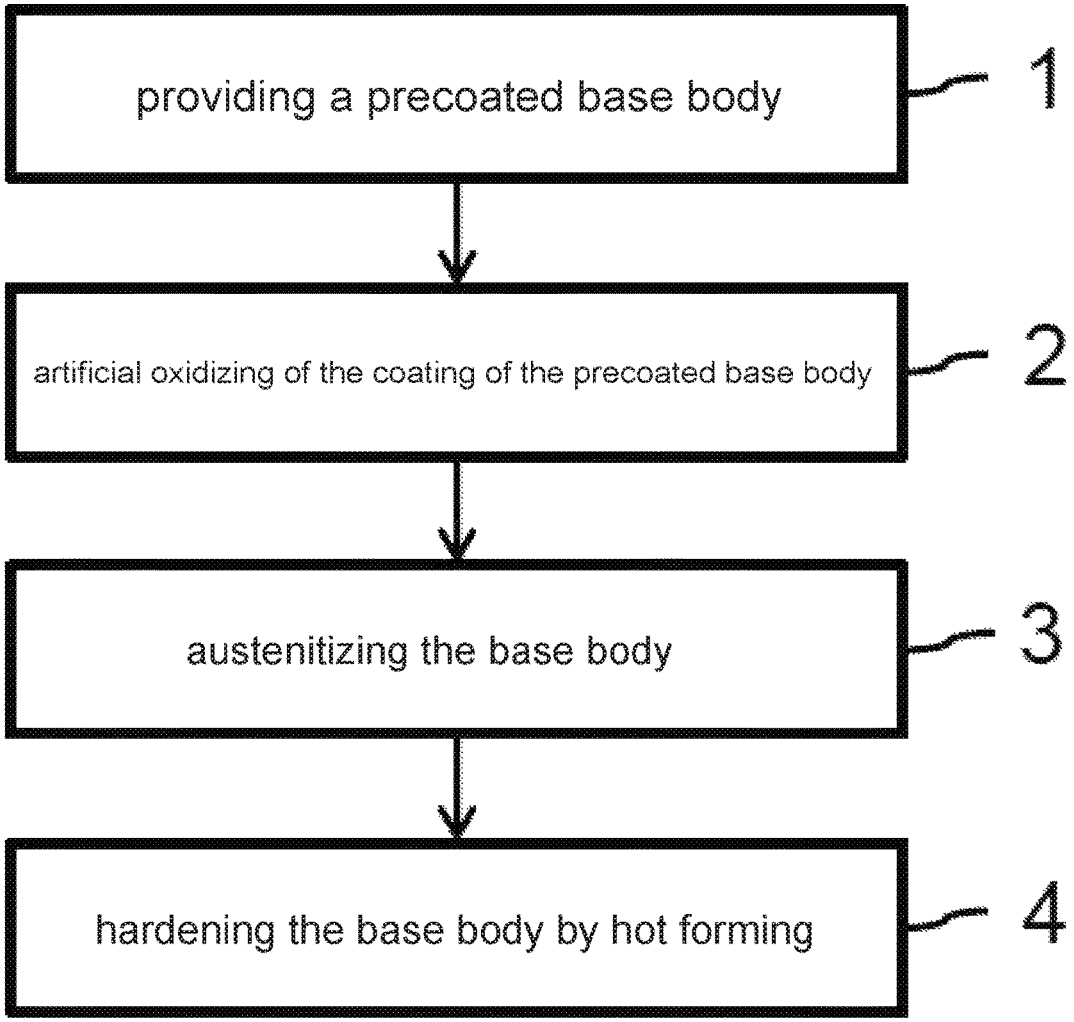
providing a precoated base body
1
artificial oxidizing of the coating of the precoated base body
2
austenitizing the base body
3
hardening the base body by hot forming
4

METHOD FOR PRODUCING A COATED BODY HARDENED BY HOT FORMING AS WELL AS A BODY PRODUCED ACCORDING TO THE METHOD

CROSS-REFERENCE TO RELATED APPLICATION

This application claims priority to German Patent Application No. 102015016656.5, filed Dec. 19, 2015, which is incorporated herein by reference in its entirety.

TECHNICAL FIELD

The present disclosure pertains to a method for producing a coated body hardened by hot forming. The method is particularly well-suited for producing a car body or structural component of a motor vehicle, for example of a B-column, an A-column or of a door sill. A base body made of metal is pre-coated with a metallic material. While the method is well-suited for producing vehicle body components, the present disclosure is not limited to the application in the automotive sector, but can in fact be used in all technical sectors, in which hot forming parts are used and/or produced.

BACKGROUND

In the case of a coating, which is able to break down water into hydrogen and oxygen, there is a risk that the coating reacts with the water content present in the ambient atmosphere, in particular in the form of water vapor, by forming atomic hydrogen. There is a risk thereby that this hydrogen and/or hydrogen, which is already present in the ambient atmosphere, enters the material of the base body and leads to a charging of the base body with atomic hydrogen in an undesirable way. For a hardened base body, which is charged with hydrogen, there is a risk of a hydrogen embrittlement, whereby the maximum sustainable tension is reduced significantly. This can also lead to a hydrogen-induced brittle fracture of the body produced from the base body and hardened by hot forming, in particular in response to tensioning for the purpose of installation or joining, for example by means of welding.

There is a risk of the input of atomic hydrogen into the material of the base body in particular during austenitization of the base body, because the heating of the precoated base body favors a reaction of the coating with the water, which is present in the ambient atmosphere, by forming atomic hydrogen.

Under this aspect, all metallic coatings, which are able to reduce water vapor by forming hydrogen in response to elevated temperatures, as they appear during austenitizing, for example, are to be considered as being problematic with regard to a hydrogen charging of the base body.

The problem of the formation of atomic hydrogen by a reaction of the coating with water vapor present in the atmosphere appears in particular in the case of aluminum coatings or aluminum-containing coatings, such as zinc aluminum, aluminum silicon or zinc magnesium or also combinations of zinc, aluminum and/or magnesium, which break down water vapor into hydrogen and oxygen in response to heating.

A further problem occurs in particular in the case of aluminum-containing coatings, for example aluminum silicon-coated sheets, in the case of which the coating is in contact with other materials in response to an elevated temperature. This is so, for example, when austenitizing and the associated heating of the material takes place in a continuous furnace and when the coating comes into contact with the rollers of the furnace, which are preferably made of a ceramic material. The rollers can be transport rollers or also rollers for a press hardening, for example. Due to the small thickness of the oxidized layer of the coating, the oxidized layer of the coating might be penetrated in response to mechanical stress to the above-described base body. The coating might furthermore also melt partially. The rollers thus contact the melt of the coating, which can lead to an infiltration of the rollers with the melt of the coating, among others. This contact can lead to damages to the transport rollers and finally to a breakage of the rollers, in particular in the case of an aluminum silicon coating.

In response to a breakage of the oxide layer in a furnace, the coating furthermore comes into contact with the furnace atmosphere, which is present in the furnace, which, in turn, leads to the formation of hydrogen by reaction of water vapor present in the furnace atmosphere with the melt of the coating, whereby the produced body hardened by hot forming, has an inadmissibly high content of diffusible, atomic hydrogen. This must be considered as being critical in particular in the case of furnaces, in the case of which significant quantities of water vapor are present in the furnace atmosphere.

A method for producing a coated body hardened by hot forming made of a base body made of metal, which is precoated with a metallic material, is known from EP 2 507 503 A2, whereby the precoated base body is austenitized in a method step. To ensure a sufficient oxidation of the coating while simultaneously reducing the risk of a hydrogen embrittlement, it is proposed to heat a printed circuit board, which is provided with a coating, in a furnace. A metallic alloy layer is formed on the printed circuit board at least area by area. The atmosphere inside the furnace is controlled by the supply of pretreated air, in that the pretreated air is dried prior to being supplied. The portion of dissolved water in the form of water vapor is thus reduced inside the furnace atmosphere, an less water, which can be broken down, is present in the atmosphere of the furnace. A possible hydrogen embrittlement of the printed circuit board hardened by hot forming is thus reduced by means of hydrogen, which enters the material.

SUMMARY

An improved method is provided for producing a coated body hardened by hot forming and made of a base body made of metal, which is precoated with a metallic material, in such a way that a sufficient oxidation of the coating, in particular a sufficient mechanical stability of the oxidized layer, is ensured and the formation of atomic hydrogen is prevented in response to the austenitizing of the precoated base body, also in the case of an atmosphere, which contains water vapor.

Provision is made in the case of the method according to the present disclosure for producing a coated body hardened by hot forming and made of a base body made of metal, which is precoated with a metallic material, for the precoated base body to be austenitized in a method step and to be hardened by hot forming after the austenitizing. The coating of the precoated base body is oxidized artificially prior to the method step of the austenitizing.

The oxidation is thereby not limited to the formation of a metal oxide, but generally describes the change of the oxidation stage of an elementary metal, which is present in the coating, from the oxidation stage 0 to a positive oxidation stage. For example, aluminum oxide and/or aluminum hydroxide can be formed in response to the oxidation of aluminum, wherein aluminum is present in the above-mentioned compounds in the oxidation stage +3.

In response to the austenitizing, the structure of the base body is preferably austenitized completely. However, a partial austenitization is also possible.

BRIEF DESCRIPTION OF THE DRAWINGS

The present disclosure will hereinafter be described in conjunction with the following drawing FIGURES, wherein like numerals denote like elements. FIG. 1 shows a flowchart of the method for producing a coated body hardened by hot forming.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The hardening by hot forming occurs by means of press hardening, for example, of the austenitized base body, wherein a water-cooled forming tool is preferably used. Provision is made for a partial or complete martensitic and/or bainitic structure to be formed in response to the hardening.

For example, the coating of the base body is an elementary aluminum coating and/or an aluminum-containing alloy, for example an aluminum-silicon alloy. However, it is also quite possible for the base body to be coated with magnesium and/or a magnesium-containing alloy. The base body is preferably a body made of steel, in particular 22MnB5 steel. The coating is preferably applied to the base body by hot dipping, in particular hot-dip aluminizing. The base body can be a sheet, a printed circuit board produced from a plurality of individual sheets, for example a tailor welded blank, a coil, for example a tailor welded coil, in particular a steel coil, or a component, which was cold formed first, among others. It is quite possible for the base body to have different thicknesses without welding seam, as a result of flexible rolling.

The separate method step of oxidation ensures that the formed, oxidized layer of the coating, which acts as inert layer, is embodied with a sufficient quality and thus prevents the entry or the formation of atomic hydrogen, in particular in response to the subsequent method step of the austenitizing. It is quite possible for the oxidized layer of the coating to furthermore act as reducing agent and oxidizes the available hydrogen, which comes into contact with the coating, into water. The method step of the oxidation thus makes it possible to carry out the subsequent method steps, in particular the austenitizing, under ambient atmosphere, so that an extensive reprocessing of the atmosphere surrounding the base body in response to the austenitizing, in particular a drying of the atmosphere, is no longer necessary. It is thus not necessary to control the furnace atmosphere in an energy- and cost-intensive manner by means of heating in a furnace, for example by a dew point measurement, in response to the austenitizing, and to supply pretreated air, for example dried air. A base body oxidized in this manner is in particular not susceptible to an increase of the dew point or a sudden elevation of the dew point, respectively, in the furnace atmosphere.

By separating the method step of the oxidation of the coating from the subsequent austenitization, the embodiment of the oxide layer is independent from the method step of austenitizing and will not have a negative effect on the austenitizing, for example the method speed.

It is advantageous when, after the method step of the oxidation, the coating of the base body has an oxidized layer with a thickness of between 0.05 μm and 30 μm, preferably between 0.1 μm and 10 μm. A thickness of the oxide layer formed in this manner ensures that the oxide layer is prevented from breaking open in response to a mechanical stress, for example during the transport, in particular during the transport on transport rollers of a continuous furnace. The formation of a breaking point, at which an input of atomic hydrogen can occur, and an associated hydrogen charging of the base body is prevented through this.

A direct contact between a transport device and the coating, in particular of the melt of the coating of the base body, which leads to a strong thermo-chemical reaction and/or infiltration of the transport device, for example, by means of the non-oxidized coating, is also prevented. The oxidized layer thus protects for example the ceramic rollers of a continuous furnace against an infiltration. This protection is to be considered as being advantageous in particular in the case of aluminum-silicon-coated base bodies and roller hearth furnaces including ceramic rollers. The thickness furthermore also prevents the oxide layer from breaking open in response to mechanical stress during the method step of the austenitizing and/or press hardening.

The coating of the precoated base body is preferably oxidized in such a way that, after the method step of the oxidation, the coating of the base body has an oxidized layer, which has a larger thickness than the natural oxide layer. The natural oxide layers, as they are created under ambient atmosphere and, if applicable under the influence of heat in a furnace, for example during the process of the austenitizing, are typically only very thin, so that this oxide layer can break open easily by the influence of external forces, for example in response to the transport of the precoated base bodies in a continuous furnace, so that a protective effect of the oxide layer in the area of the breaking point is prevented.

Provision is made in particular for an aluminum oxide layer, which has a layer thickness of at least 0.1 μm and which is thus many times thicker than a natural oxide layer, to be formed in response to the artificial oxidation of an aluminum-containing coating. In the case of an aluminum-silicon coating, it is typically 0.01 μm.

Due to the method step of the oxidation, which precedes the method step of the austenitization, it is quite possible for the austenitization to take place in a first furnace at ambient atmosphere. Provision is made in particular for the austenitization to take place at a temperature of between 700° C. and 1050° C., preferably between 880° C. and 980° C., particularly preferably between 910° C. and 950° C., and in particular at a furnace time of between 10 seconds and 10 minutes, preferably between 5 and 7 minutes. The austenite area can be varied by alloying other metals. For example, the alloying of manganese to a steel typically leads to a shift of the austenite area at lower temperatures. It is quite possible for the furnace to be embodied as induction furnace. The power density is thus not dependent on the heat transfer on the surface, whereby a high power density and thus an increased process speed are possible without overheating the surface. In response to an inductive heating, a selective heating of a partial area of the precoated base body is also possible. Due to the fact that the heating of the precoated base body can take place at ambient atmosphere, an extensive processing and control of the furnace atmosphere is not necessary. An input of atomic hydrogen and/or a chemical reaction of the coating with the water vapor, which is present in the furnace atmosphere, by forming hydrogen is prevented by means of the oxidized layer of the coating. A prior dehumidification of the air and a dew point measurement as well as a cost-intensive dew point regulation can thus be forgone. The input of large quantities of water vapor into the furnace atmosphere, as it can occur in response to a breakage of a gas-heated steel pipe in a continuous furnace, for example, is also not critical, because the oxidized layer prevents an entry of elementary hydrogen and/or a formation of atomic hydrogen in the case of a reaction with the non-oxidized coating.

Provision is made in an advantageous further development for the method step of the austenitizing to take place in a first furnace, which is embodied as multilayer chamber furnace. Multilayer chamber furnaces are characterized by a small space end energy requirement. In the case of multilayer chamber furnaces, however, a control and/or adaptation of the furnace atmosphere is not possible at all or only in a very elaborate manner, so that the prior oxidation proposed according to the present disclosure is a necessary requirement for the use of a typical multilayer chamber furnace.

Provision is made in a preferred embodiment for the oxidation to take place in a second furnace under oxygen-containing atmosphere, preferably ambient atmosphere.

However, it is also quite possible for the furnace atmosphere of the second furnace to have a humidity, which is increased as compared to the ambient air.

The temperature of the second furnace is preferably smaller than or equal to the melting temperature of the coating metal in the case of an elementary coating, and is smaller than or equal to the solidus temperature of the alloy in the case of a coating of a metallic alloy. An even oxidation of the coating in a sufficient thickness is ensured through this.

The oxygen-containing atmosphere in the second furnace preferably has a higher oxygen content than the ambient atmosphere. Provision is made in particular for the oxygen content to be larger than 18 percent by volume, preferably between 19 and 50 percent by volume. However, 100 percent by volume are quite possible as well.

Provision is made in an advantageous further development of the present disclosure for the precoated base body to be cooled down to a temperature of between 20° C. and 200° C. in a time between 10 seconds and 1200 minutes, following the heating in the second furnace and prior to the method step of the austenitizing. From 200° C., a deformation is not to be expected any longer. For saving energy and time in response to the austenitizing, the base body is preferably cooled down to a temperature, which is elevated as compared to the room temperature.

Provision is made in a particularly preferred embodiment for the oxidation to take place by means of anodic oxidation, preferably by means of anodizing. The anodic oxidation ensures a simple and even oxidation of the coating. In anodic oxidation methods, the thickness as well as the composition of the oxide layer can also be influenced and controlled in a simple manner. In particular, in the case of aluminum-containing coatings, a thickness of the oxidized layer of between 1 μm and 30 μm and thus a much thicker oxide layer than the natural oxide layer of such a coating can be reached by the anodic oxidation, in particular by an electrolytic oxidation process.

The anodic oxidation preferably takes place in an electrolyte bath, wherein in particular an acid bath, preferably a sulfuric acid bath, is used.

It is quite possible for the method step of the anodic oxidation to take place in a continuous process and/or dipping process.

Provision is made in an alternative embodiment of the method for the oxidation to take place by a chemical reaction of the coating with a chemical oxidizing agent, in particular a permanganate compound, preferably potassium permanganate.

In response to the artificial oxidation of the coating, a metal compound is preferably formed in the coating, wherein the metal compound is thermally stable in the case of the method step of the austenitizing. Provision is made in particular for the oxidized layer to have a metal oxide, preferably an aluminum oxide, and/or a metal phosphate, preferably an aluminum phosphate. It is considered to be particularly advantageous, when an aluminum orthophosphate is formed in response to the oxidation. Aluminum oxide and aluminum orthophosphate are characterized by a very high melting point. In the case of aluminum oxide, the melting point is above 2000° C. and in the case of aluminum orthophosphate, it is above 1500° C., so that these oxide layers survive a subsequent heat treatment in one or a plurality of subsequent heating processes because of their thermal stability. The melting points of these two aluminum compounds are above the austenitizing temperatures of metallic materials, which are typically used for the base body. For example, an austenitizing of 22MnB5 steel typically takes place at temperatures of between 800° C. and 1000° C. and thus below the melting temperature of aluminum oxide and aluminum orthophosphate.

Provision is made in an advantageous further development of the method for a metal compound to be formed in the coating in response to the oxidation of the coating, wherein this metal compound breaks down thermally in response to the subsequent method step of the austenitizing, wherein a thermally stable metal compound is formed. It is possible in the case at hand for an aluminum hydroxide or a metal carbonate, preferably a zinc carbonate or a metal sulfate to be formed in response to the oxidation.

It is considered to be particularly advantageous in this context when a protective gas is formed in response to the thermal breakdown of the thermally unstable metal compound. This is advantageous in particular, when the thermal breakdown occurs in response to the process of the austenitizing. The protective gas formed in response to the thermal breakdown suppresses the atmosphere, which is present, for example the furnace atmosphere, in the area adjoining the base body and/or the coating, so that a contact of the coating and/or of the base body with the atmosphere at hand is prevented completely or is at least reduced. An input of atomic hydrogen, which can lead to a hydrogen embrittlement of the body produced from the base body and hardened by hot forming, or a reaction of hydrogen with the coating by forming hydrogen, is thus made more difficult. A metal carbonate, for example, is possible as metal compound, which separates a protective gas in response to a thermal breakdown. For example, zinc carbonate breaks down into zinc oxide and the protective gas carbon dioxide above a temperature of 300° C.

After the method step of the oxidation and/or the step of the austenitization, the coating preferably has an oxide layer, which is oxidation-resistant and/or corrosion-resistant.

It is quite possible for the coating of the base body to be embodied on a partial area of the base body and/or for a partial area of the coating of the base body to be oxidized and/or for a partial area of the base body to be austenitized.

A body produced by means of the above-mentioned method, hardened by hot forming and having an oxidized coating, has an oxidized layer with a thickness of between 0.05 μm and 30 μm, preferably of between 0.1 μm and 10 μm.

With reference now to FIG. 1, a base body made of metal, which is precoated with a metallic material, is provided in a first step 1. In a subsequent step 2, this coating is oxidized artificially so as to avoid a hydrogen charging of the base body in response to the subsequent methods steps of the austenitizing of the base body, step 3, and the hardening of the base body by hot forming, step 4, among others.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for producing a coated body hardened by hot forming comprising:

applying a coating of metallic material to a metal base body to form a precoated base body;

oxidizing the precoated base body in an oxidizing environment relative to an ambient atmosphere to form an oxidized, precoated base body having an oxidized layer with a thickness of at least 0.1 μm;

austenitizing the oxidized, precoated base body to form an austenized part; and hardening the austenitized part by hot forming.

2. The method according to claim 1, wherein the oxidization produces the oxidized layer on the oxidized, precoated base body having a thickness of between 0.1 μm and 10 μm.

3. The method according to claim 1, wherein austenitizing takes place in a first furnace having ambient atmosphere and a temperature of between 700° C. and 1050° C., and for a time period between 10 seconds and 10 minutes.

4. The method according to claim 3, wherein the first furnace is embodied as multilayer chamber furnace.

5. The method according to claim 3, wherein the first furnace has a temperature between 910° C. and 950° C.

6. The method according to claim 3, wherein the time period is between 5 and 7 minutes.

7. The method according to claim 1, wherein austenitizing takes place in a first furnace and oxidation takes place in a second furnace under oxygen-containing atmosphere.

8. The method according to claim 7, wherein the temperature of the second furnace is less than or equal to the melting temperature of a metal coating in the case of an elementary coating, and is less than or equal to the solidus temperature in the case of a coating of a metallic alloy.

9. The method according to claim 7, wherein the oxygen content is between 19 and 50 percent by volume greater than the ambient atmosphere.

10. The method according to claim 1, wherein oxidation comprises anodic oxidation.

11. The method according to claim 10, wherein the anodic oxidation takes place in an electrolyte bath.

12. The method according to claim 11, wherein the electrolyte bath comprises an acid bath.

13. The method according claim 1, wherein the oxidation takes place by a chemical reaction of the coating with a chemical oxidizing agent.

14. The method according to claim 13, wherein the chemical oxidizing agent comprises a permanganate compound.

15. The method according to claim 1, further comprising forming a metal compound which is thermally stable in response to austenitizing the precoated base body.

16. The method according to claim 15, wherein the metal compound is selected from a group consisting of an aluminum oxide, a metal phosphate, and an aluminum phosphate.

17. The method according to claim 1, further comprising:

forming a thermally-unstable metal compound in the coating when oxidizing in the precoated base body; and thermally breaking down the thermally-unstable metal compound to form a thermally stable metal compound when austenitizing the oxidized, precoated base body.

18. The method according to claim 17, wherein the metal compound is selected from a group consisting of a metal hydroxide, an aluminum hydroxide, a metal carbonate and a zinc carbonate.

19. The method according to claim 17, wherein thermally breaking down the thermally-unstable metal compound comprises forming a protective gas for suppressing the atmosphere surrounding the oxidized, precoated base body when austenitizing the oxidized, precoated base body.

* * * * *